US008771151B2

(12) United States Patent
Larsson

(10) Patent No.: US 8,771,151 B2
(45) Date of Patent: Jul. 8, 2014

(54) ADJUSTABLE EXERCISE APPARATUS SIMULATING A KAYAK

(76) Inventor: Lars Larsson, Palm Springs, CA (US)

( * ) Notice: Subject to any disclaimer, the term of this patent is extended or adjusted under 35 U.S.C. 154(b) by 424 days.

(21) Appl. No.: 13/317,876

(22) Filed: Oct. 31, 2011

(65) Prior Publication Data

US 2012/0196727 A1 Aug. 2, 2012

Related U.S. Application Data

(63) Continuation-in-part of application No. 12/931,394, filed on Jan. 31, 2011, now abandoned.

(51) Int. Cl.
*A63B 21/00* (2006.01)

(52) U.S. Cl.
USPC ..... 482/72; 482/95; 482/96

(58) Field of Classification Search
USPC ..... 482/71, 72, 95, 111, 112, 96, 62, 57, 482/51, 142, 130, 63
See application file for complete search history.

(56) References Cited

U.S. PATENT DOCUMENTS

| | | | | |
|---|---|---|---|---|
| 5,803,876 | A * | 9/1998 | Hickman | 482/72 |
| 5,913,752 | A * | 6/1999 | Bolf | 482/72 |
| 6,149,552 | A * | 11/2000 | Chen | 482/72 |
| 7,553,261 | B2 * | 6/2009 | Carbone | 482/72 |

* cited by examiner

*Primary Examiner* — Jerome w Donnelly
(74) *Attorney, Agent, or Firm* — I. Michael Bak-Boychuk

(57) ABSTRACT

An exercise assembly simulating the muscular movements of a kayaker includes an elongate seat resiliently mounted on an elongate spine structure supported on adjustable pedestals that are each further resiliently mounted. At the front end an adjustably aligned pivot engages through a U-joint a simulated kayak paddle with the motion of the pivot resisted by restricted orifice cylinders mounted in the spine structure. A generally uniform adjustment arrangement is utilized to conform the assembly to the various users and/or various exercise levels.

14 Claims, 4 Drawing Sheets

ADJUSTABLE EXERCISE APPARATUS SIMULATING A KAYAK

REFERENCE TO RELATED APPLICATIONS

This application is a continuation-in-part of U.S. patent application Ser. No. 12/931,394 filed Jan. 31, 2011 now abandoned, and the benefit of this earlier filing date is claimed for all matter common therewith.

BACKGROUND OF THE INVENTION

1. Field of the Invention

The present invention relates to exercise structures and more particularly to structures focused on exercising the upper torso and abdominal musculature of a person by simulating the rowing motions of a kayak at enhanced effort levels associated with stabilizing a resiliently supported body alignment of the user by simulating the rowing movements of a kayak.

2. Description of the Prior Art

The exponential growth of automation has long surpassed nature's ability to adjust our habits, committing virtually all of us to a sedentary lifestyle both in the course of our work and also at home where we engage in our repose the various entertainment modalities. As a consequence obesity is now a significant health hazard exacerbated by increases in heart disease, diabetes and similar conditions that reduce both the quality and also the expected length of human life. Simply, these lifestyle changes are occurring at a rate that cannot be accommodated by evolutionary response and as we each perceive this state the impetus to exercise is now driving all of us.

These widely perceived observations along with the persistent nature that brought us all here has also resulted in all sorts of exercise mechanisms that singularly and/or in various groupings allow us to focus on one or more aspects of our musculature along with other processes including those entailed in our cardiovascular function, metabolic processes and the like. Concurrently, our attention to correct exercise is now also perceived as an effective mechanism for managing stress and has therefore pervaded our whole lifestyle with various exercise mechanisms that are not just suitable for large exercise facilities like gymnasiums, but also for use in ones home.

One physical activity that is universally associated with robust health is that of kayaking. The image of navigating down the rapids of a mountain stream as we balance the kayak by our mid torso musculatures is seen as good for one's health and as result various kayaking simulators have been devised which in one manner or another seek to duplicate this activity, as exemplified by the teachings of U.S. Pat. No. 6,328,677 issued on Dec. 11, 2001 to Drapeau; U.S. Pat. No. 6,106,436 issued on Aug. 22, 2000 to Lundahl; U.S. Pat. No. 5,803,876 issued on Sep. 8, 1998 to Hickman; U.S. Pat. No. 5,624,357 issued on Apr. 27, 1997 to Englehart et al.; U.S. Pat. No. 4,687,197 issued on Aug. 18, 1987 to this inventor and Bengt Swesson, and others.

Each of the foregoing examples, and similar others, while suitable for the purposes intended, describe a kayak simulating structure in which the user is well supported on a stationary seat and from that vantage moves a kayak paddle against weights or other force inducing resistance. Thus while providing a simple and compact exercise structure the foregoing examples confine the major exercise efforts to the arms, shoulders and the upper torso while the abdomen and the lower back are left unattended.

An exercise structure that takes benefit of the simplicity of a kayak and that fully and completely involves the mid torso musculature of the user is therefore extensively desired and it is one such structure that is disclosed herein.

SUMMARY OF THE INVENTION

Accordingly, it is the general purpose and object of the present invention to provide a kayak simulating exercise structure in which only the user's lower legs are securely restrained while the remaining body portions are all free for involvement in the simulated paddle motion.

Other objects of the invention are to provide a resiliently mounted kayak simulating exercise structure in which the torso movements of the user are compelled in the course of stabilizing the alignment thereof on a resiliently mounted seat.

Yet additional, further and other objects of the invention shall become apparent from the examination of the teachings that follow in conjunction with the illustrations appended.

Briefly, these and other objects are accomplished within the first form of the present invention by providing a generally elongate longitudinal seat supported on a transverse, cushion mounted, pedestals at its front and rear ends with each of the pedestals adjustably extendable to select the desired seat inclination from horizontal. The seat itself may be formed as a generally U-sectioned structure defined by two lateral walls on the sides of a supporting panel covered by a cushioning pad on which an exercising user may sit with his or her lower back supported by an adjustably mounted lower back support pillow while the user's legs extend over the front edge of the seat.

At the front end this elongate seat structure is adjustably engaged to a generally vertical bearing assembly pivotally mounted between the walls of a U-sectioned mounting bracket to support at various inclinations therein a bearing yoke engaged to the exterior of a telescoping shaft assembly that at its free upper end includes a U-joint that is engaged to the midpoint of the kayak paddle shaft. The lower end of the telescoping shaft assembly, in turn, extends beyond the bearing yoke within the hollow interior of the seat structure to engage at the ends of two radially opposed bellcranks mounted thereon the respective ends of a pair of gas filled, orifice restricted struts which then provide the resistance to the paddle movement at the upper end.

The deployment of the foregoing articulated paddle mount at the front edge of the seat results in a split seat surface on the sides thereof on which the thigh portions of the user's legs are positioned with the lower leg portions then extending onto a pair of foot rests on the adjustably engaged front support pedestal. This arrangement provides an interlocking engagement between the user's legs and the seat structure while the remaining body portions including the torso of the user are supported by the narrow seat surface restrained against rearward motion by the lower back support pillow. In this manner most of the user's body is effectively unrestrained as he or she reaches upwards and forwards to articulate the paddle from the rearward weight biased inclined alignment set by the adjustment of the cushion mounted support pedestals, with the resulting upper torso weight creating unbalances that are fully analogous to that of a kayak which then need to be stabilized by the extent and vigor of the paddle movement.

In accordance with the second form of the present invention these same unbalanced states that inherently drive the user to even higher efforts are even more emphasized by supporting on a resilient mounting of the seat itself where this further level of added resilience then emphasized by added seat height which is then enhanced even more by resilient restraints provided at each of the foot supports, thus compelling even higher mid-torso efforts in the course of use. Consequently the whole focus of this exercise structure is further enhanced with the resiliently mounted support structure compelling the user to achieve a balance state solely by his or her sheer vigor.

It will be appreciated that in both instances this resilient mounting is stabilized only by the inertia and resistance associated with the articulation of the paddle enhanced both by the mass inertia on the paddle ends and by the selectively connected restricted orifice struts opposing the lower end of the paddle shaft within the interior cavity formed by the seat structure. In this manner an exercise assembly is provided in which various levels of resistance can be set and which effectively modifies the levels of involvement of the whole torso musculature by the simple inclination adjustment of the frame. All this is achieved without the joint degrading consequences associated with walking or jogging or the tendon damage that sometimes results from lifting weights.

DESCRIPTION OF THE PREFERRED EMBODIMENTS

Figure 1:
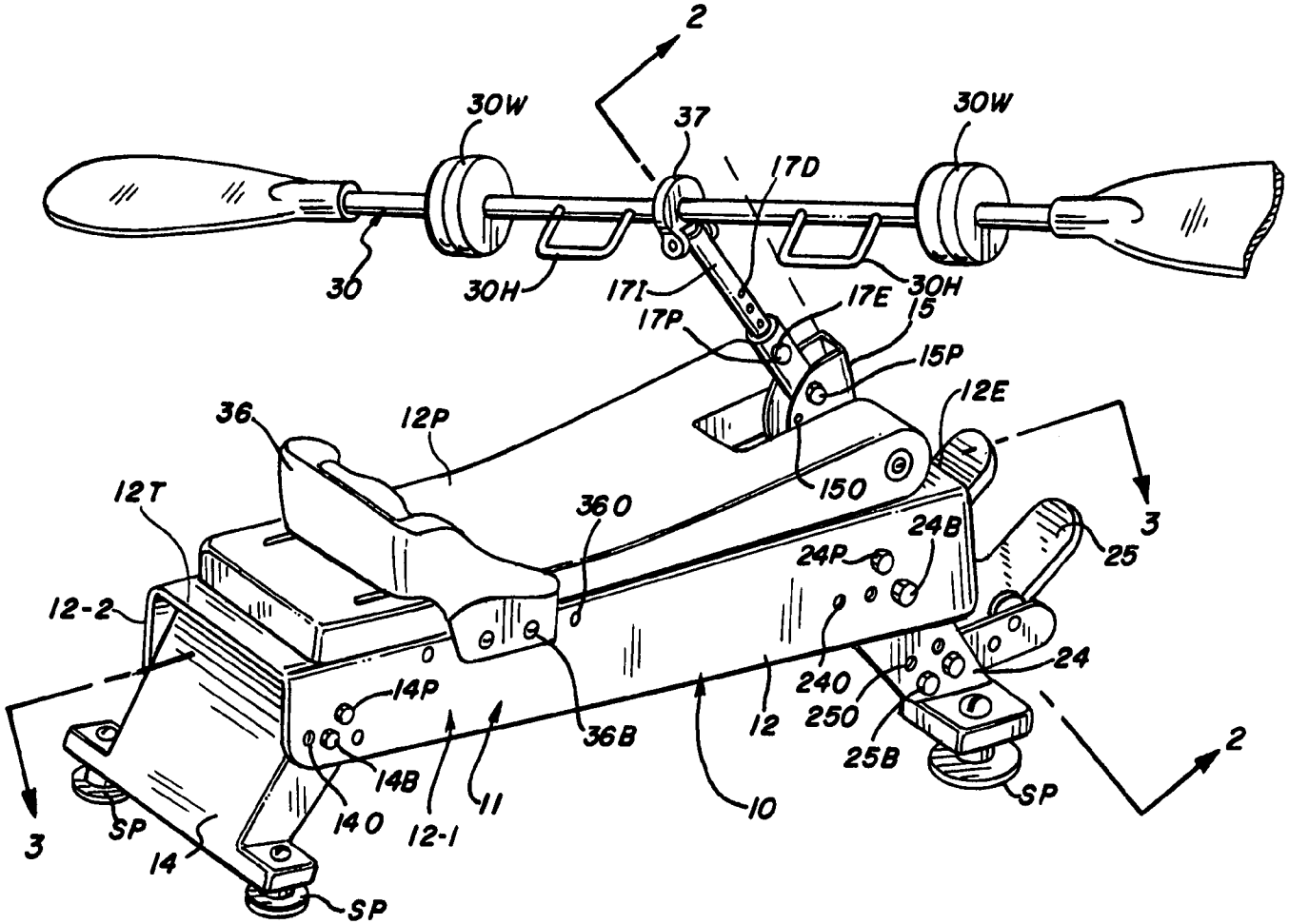
FIG. 1 is a perspective illustration of a first embodiment of the inventive kayak simulating exercise structure conformed for use in its inclined alignment.
Figure 2:
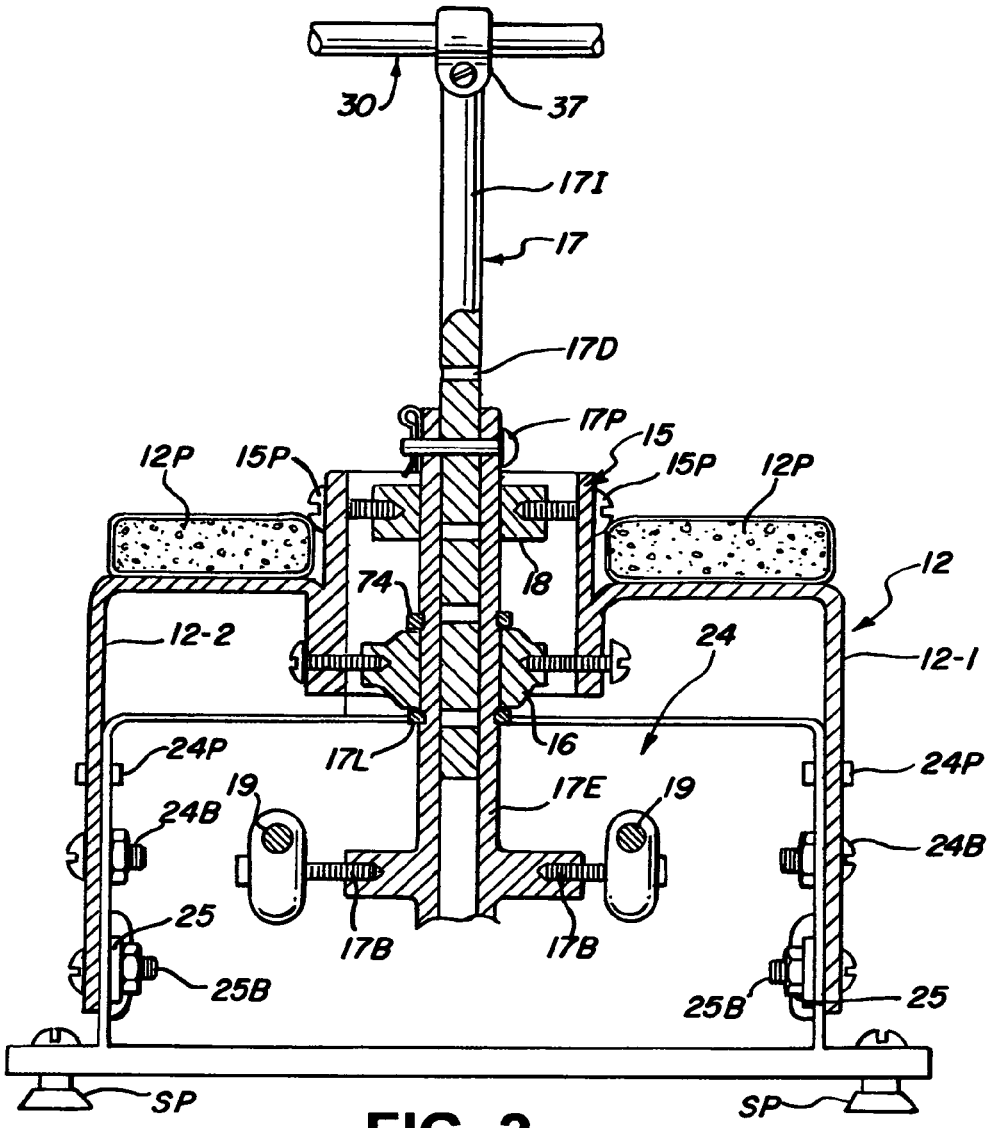
FIG. 2. is a sectional view of the first embodiment of the inventive exercise structure taken along line 2-2 of FIG. 1.
Figure 3:
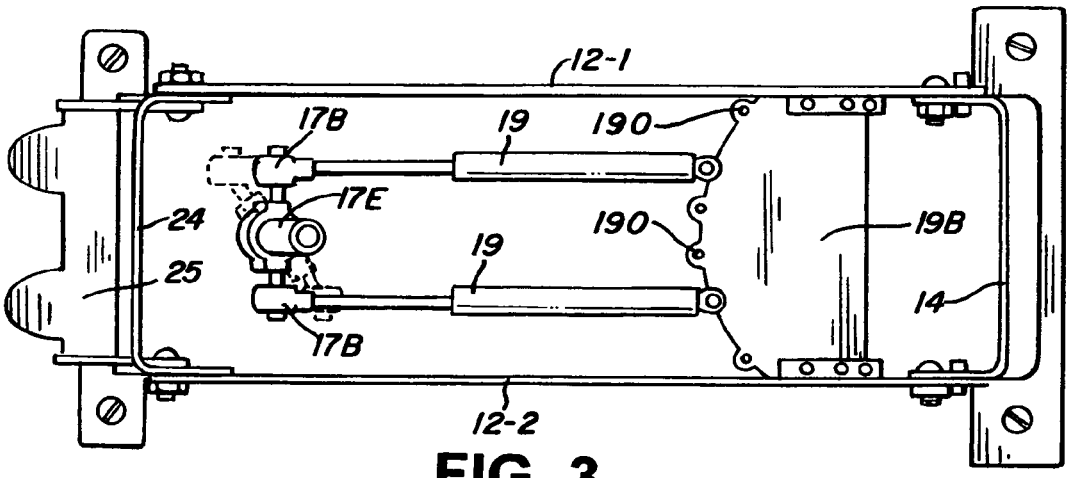
FIG. 3 is yet another sectional view of the first embodiment of the inventive exercise structure taken along line 3-3 of FIG. 1.

As shown in FIGS. 1 through 3 the first embodiment of the inventive kayak simulating exercise structure, generally designated by the numeral 10, comprises an elongate seat assembly 11 defined by a generally U-sectioned elongate spine piece 12 defined by two opposed lateral wall surfaces 12-1 and 12-2 bridged by a top surface 12T that is then covered by a padding layer 12P. The interior cavity in the spine piece 12 that is thus formed receives in a selectively adjustable engagement the top of a transverse rear pedestal 14, the adjustable connection thereof to the side walls 12-1 and 12-2 being effected by pivot posts 14P spaced from a row of openings 14*o* one of which is then selectively fixed by a bolt 14B to determine the rear edge of the seat height above a set of resilient support pads SP supporting the pedestal bottom on the ground.

A similarly constructed front pedestal assembly 24, again pinned by pivot posts 24P and aligned by them capture of bolt 24B in one of the plural openings 24*o*, provides the front support for the assembly, again cushioned by the resilient pads SP. This front support, however, extends subjacent the front edge of the seat over which the legs of the user are draped and therefore includes a foot rest panel 25 again adjustably mounted relative the front pedestal 24 by selective engagement of attachment bolts 25B within one of the several openings 25*o*. Also adjustably mounted to the front end 12E of the seat structure is a generally vertical U-sectioned support bracket 15 extending through the top surface 12T to pivotally mount a bearing yoke or collar 16 in which a tubular exterior sleeve 17E of a telescoping mount 17 is received for rotation while axially restrained within the bearing yoke by an upper and lower retaining ring 17U and 17L.

With the feet now supported on the foot rest panel 25 and aligned on either side of the front edge 12E of the resulting seat structure, as bisected by the U-shaped support bracket 15, the axial telescoping extension of the inner shaft 17I may be fixed to the desired height by inserting a pin 17P through the common interior of a set of openings 17*o* in the exterior sleeve 17E and one of several drillings 17D in the inner shaft. The shaft inclination, in turn, is concurrently fixed by selective engagement of pins 15P in one of several openings 15*o* in the walls of bracket 15 and a corresponding opening 18O in an adjustment fixture 18 on shaft assembly 17. Of course, the pivotal articulation of the bearing yoke 16 may also be left unrestrained for expanded exercise use in the manner of symmetrical rowing as in rowing a boat.

The lower portion of the exterior sleeve 17E forming the telescoping shaft assembly 17 that extends into the interior cavity within the seat structure includes a set of opposed, radially projecting bellcranks 17B each engaging at its free end a corresponding end of one of a pair of conventional gas filled, orifice restricted, struts 19 such as those sold under part no. 171BEQ by Magnus Mobility Systems, Inc., 1912 West Business Center Dr., Orange, Calif. 92867 which at their other ends are each respectively pinned to one of a plurality of openings 19*o* in a transverse bracket 19B spanning between the side walls 12W. In this manner the torsional forces about the rotary axis of the shaft assembly 17 or the resistive forces opposing the pivotal movement of the bearing yoke 16 are conveniently adjusted to match the level of effort desired.

Once thus adjusted the a paddle assembly 30 engaged to a U-joint 37 at the free end of the interior shaft 17I provides the necessary exercise forces to the user sitting on seat pad 12P with the legs straddling the mount assembly 15. From this relatively unrestrained position the user, while sitting on seat pad 12P restraining only his or her legs over the seat edge and in the foot rests providing positional control, reaches to extend his or her arms to grasp the paddle 30 on each side of the U-joint 37 and only through that connection obtains any force resistance. To provide some positional reference a seat back cushion 36 may be adjustably mounted, again by bolts 36B engaging one of several openings 36*o*, on the seat pad 12P.

Those skilled in the art will appreciate that the elongate form of the spine piece 12 and the also the seat pad 12P mounted thereon provide little lateral support to the user, thus confining all position control to the leg engagement between the seat edge and the foot rests 25. With this limited body engagement virtually all of the abdominal musculature, the musculature of the lower back and also the musculature of the chest and upper back are all involved in maintaining a proper seated position as the paddle 30 is cyclically articulated. This muscular involvement becomes even more exacerbated by the resistance of the struts 19 and the resilience of the support pads SP.

Figure 4:
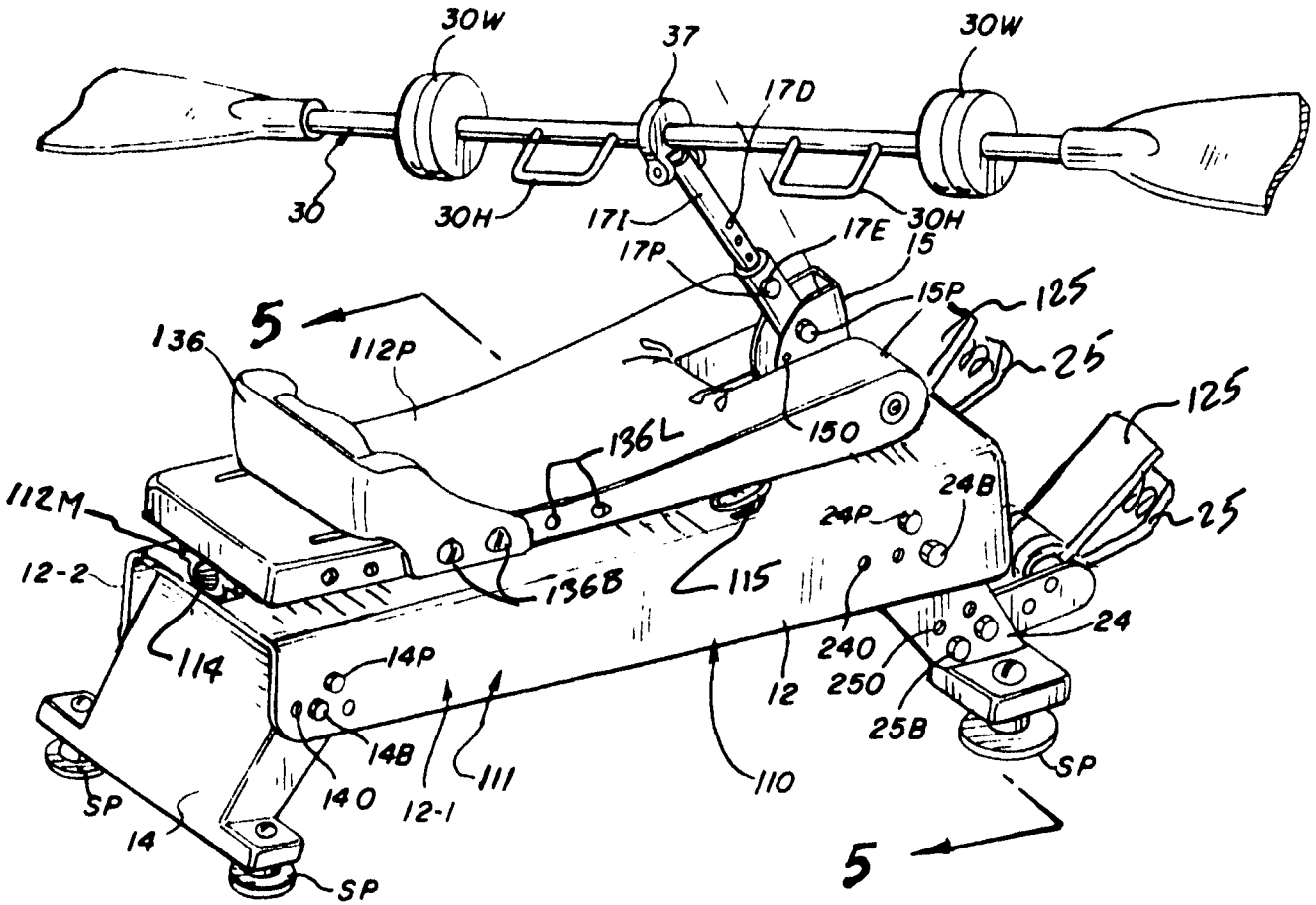
FIG. 4 is a further perspective illustration of a second embodiment of the inventive kayak simulating exercise structure deployed for use.
Figure 6:
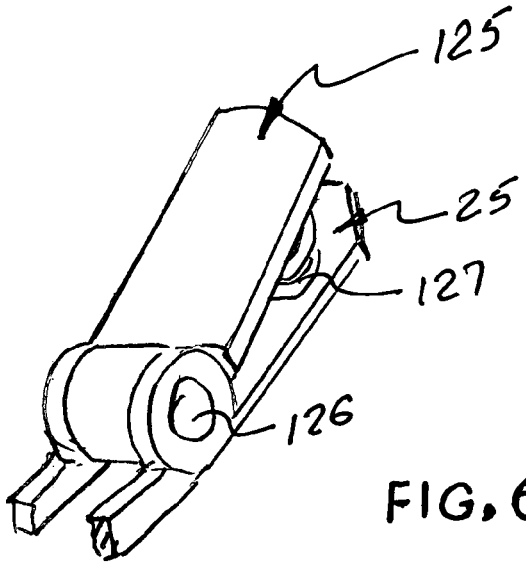
FIG. 6 is a perspective detail, in partial section, of a spring opposed foot restraint useful with the invention herein.
Figure 5:
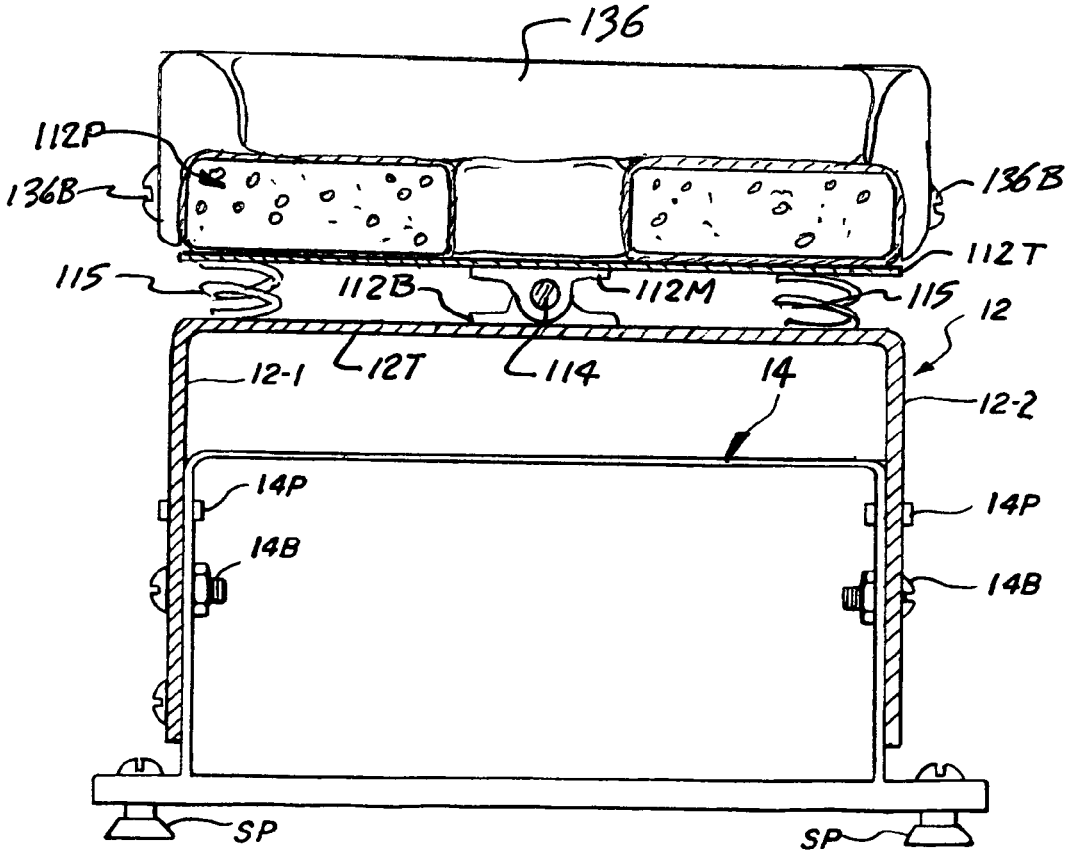
FIG. 5 is a further sectional view illustrating the spring restrained seat engagement in accordance with the second implementation of the inventive kayak simulating exercise structure useful to expand the level of the exercise vigor by the expansion of the range of torso imbalance.

By particular reference to FIGS. 4-6 a second embodiment of the present invention, generally designated by the numeral 110, further enhances the torso balancing exercise effort by inserting a further resilient structure between a modified seat structure 112P and the spine structure 12. Like numbered parts functioning in a like manner to that previously described, the top bridging surface 12T of the spine assembly 12 is provided with a set of longitudinally aligned pillow blocks 112B while the lower side of the seat structure 112P itself is bridged by a transverse panel 112T on which a corresponding longitudinally aligned set of pivot mounts 112M is mounted spaced to straddle the pillow blocks 112B so that a conforming cylindrical pivot shaft 114 can be passed can be received through their common interior.

The inherent lateral instability obtained by the foregoing pivotally supported seat spacing is then partly resiliently stabilized by a set of helical springs 115 captured in compression between the lateral edges of the lower seat panel 112T and the spine panel 12T, compelling the user to provide the remainder of the balancing forces by articulating the paddle. Of course, similar to the previous example, this compelled balancing activity is longitudinally fixed by the selective engagement of the pillow assembly 136 by fasteners 136B in one of several lateral openings 136L formed in the sides of seat 136 with further control over the level of effort then determined by the inclination obtained through the selective engagements of the front and/or rear pedestals.

This adjustable resilient supporting structure is then further enhanced by providing spring biased pedal assemblies 125 pivotally mounted on pivots 126 formed on each of the foot rests 25, each of the pedal assemblies then opposed in its pivotal motion by a captured spring 127. In consequence the whole of the body engagement contact is either through the resiliently mounted seat 136 and/or pedals 125, thereby fully simulating the balancing needs of a water supported kayak.

In each instance the desired muscular involvement levels obtained by the adjustment of the seat inclination from the horizontal, the alignment of the pivot axis, the bellcrank moment arm selection and/or the masses mounted on the oar all interact with resilient compliance of the body support structures to simulate the interactive dynamics of this torso-kayak combination. As these inclinations from horizontal are effected the resulting rearward movement of the body center of mass a lower back support pillow 36 or 136 may be once again adjustably engaged to the spine piece 12 by the mechanisms previously described. In this manner the rearward sliding of the user's lower back is limited without any significant lateral restraint.

It will be appreciated that the foregoing arrangements accommodate various body types and levels of exercise by the repeated application of a simple adjustment selection to produce a structure that effectively retains the general attributes of kayaking in which most of the user's body are laterally unconstrained while vigorous movements are carried out both against various (enhanced) levels of resistance and inclinations that themselves enhance the exercise levels. To further extend these enhancements the paddle 30 may be provided with weights 30W and may include offset handles 30H to allow the exercising of biceps which is particularly effective when the pivotal motion of the yoke is unrestrained. In each instance, like in the course of rowing a kayak, small muscular adjustments are continuously made, thus closely imitating the real event. As result an interest to perfect the movements is developed, promoting the usefulness of the exercise structure which inherently is simple and inexpensive to produce.

Obviously many modifications and variations of the instant invention can be effected without departing from the spirit of the teachings herein. It is therefore intended that the scope of the invention be determined solely by the claims appended hereto.

I claim:

1. An exercise assembly simulating the movements of a kayak on a water surface, comprising in combination:

an elongate spine defined by a front end, a rear end and an upper surface, said front end including a generally transverse edge;

a corresponding mount assembly engaged to support said front and rear ends of said spine, the engagement of a selected one of said mount assemblies to said spine including adjustment means for adjusting the inclination of said spine;

an axle defined by an upper and a lower end pivotally engaged to said front end of said spine including a handle hinged to the upper end thereof;

resistance means operatively connected to said handle for resisting the displacement thereof; and an elongate seat assembly resiliently mounted on said upper surface of said spine for resiliently supporting a user thereon.

2. An exercise assembly according to claim 1, wherein:

said resistance means is deployed subjacent said upper surface of said spine for adjustable engagement to said lower end of said axle for providing stabilizing forces to said handle for maintain said user on said seat.

3. An exercise assembly according to claim 2, further comprising:

a pair of spring urged foot rests adjustably deployed adjacent said transverse edge.

4. An exercise assembly according to claim 3, further comprising:

a back support selectively engaged to said seat.

5. An exercise assembly according to claim 2, wherein:

said elongate spine includes a pair of side walls along the lateral edges of said upper surface defining an interior cavity; and said resistance means is deployed within said interior cavity.

6. An exercise assembly according to claim 5, wherein:

each said mount assembly further includes a resilient support.

7. An exercise assembly according to claim 6, further comprising:

a pair of spring urged foot rests adjustably deployed adjacent said transverse edge.

8. An exercise assembly according to claim 7, further comprising:

a back support selectively engaged to said seat.

9. An exercise assembly, comprising in combination:

an elongate spine defined by a front end, a rear end and a top surface;

a mount assembly respectively supporting each said front and rear ends of said spine, a selected one of said mount assemblies being adjustably engaged to said spine for adjusting the inclination thereof;

a pivot shaft defined by an upper and a lower end pivotally engaged to said front end of said spine including a transverse handle hinged to the upper end of said of said pivot shaft;

resistance means connected to the lower end of said pivot shaft for resisting the articulation of said handle; and an elongate seat assembly pivotally mounted on said upper surface of said spine and resiliently urged for an upward deployment above said upper surface.

10. An exercise assembly according to claim 9, wherein:

said elongate spine includes a pair of side walls along the lateral edges of said upper surface to define therewith an interior cavity; and said resistance means is deployed within said interior cavity.

11. An exercise assembly according to claim 9, wherein:

said resistance means includes a restricted orifice cylinder.

12. An exercise assembly according to claim 9, wherein:

each said mount assembly further includes a resilient support.

13. An exercise assembly according to claim 12, further comprising:

a pair of spring biased foot rests adjustably deployed adjacent said transverse edge.

14. An exercise assembly according to claim 13, further comprising:

a back support selectively engaged to said seat.

* * * * *